US011808095B2

(12) United States Patent
Leducq et al.

(10) Patent No.: US 11,808,095 B2
(45) Date of Patent: Nov. 7, 2023

(54) DOWNHOLE CENTRALIZER

(71) Applicant: Schlumberger Technology Corporation, Sugar Land, TX (US)

(72) Inventors: Paul Leducq, Cambridge (GB); Sebastien Isambert, Clamart (FR); Francois Chevillard, Abbeville (FR); Fabio Cecconi, Clamart (FR); Vincent Chatelet, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 43 days.

(21) Appl. No.: 17/652,499

(22) Filed: Feb. 25, 2022

(65) Prior Publication Data

US 2023/0272680 A1 Aug. 31, 2023

(51) Int. Cl.

| | |
|---|---|
| ***E21B 17/10*** | (2006.01) |
| ***E21B 47/13*** | (2012.01) |
| ***E21B 17/02*** | (2006.01) |
| ***E21B 47/14*** | (2006.01) |

(52) U.S. Cl.

CPC ..... *E21B 17/1078* (2013.01); *E21B 17/0285* (2020.05); *E21B 47/13* (2020.05); *E21B 47/14* (2013.01)

(58) Field of Classification Search

CPC ..... E21B 17/1078; E21B 47/13; E21B 47/12; E21B 47/14; E21B 17/1057; E21B 17/1028

See application file for complete search history.

(56) References Cited

U.S. PATENT DOCUMENTS

| | | | | |
|---|---|---|---|---|
| 3,423,671 | A * | 1/1969 | Marcel | G01V 3/20 33/312 |
| 3,474,541 | A * | 10/1969 | Cubberly, Jr. | E21B 47/08 33/544.3 |
| 8,484,858 | B2 * | 7/2013 | Brannigan | E21B 47/08 33/544.3 |
| 2003/0164240 | A1 | 9/2003 | Vinegar et al. | |
| 2005/0082056 | A1 | 4/2005 | Baxter et al. | |

(Continued)

FOREIGN PATENT DOCUMENTS

| | | | | |
|---|---|---|---|---|
| WO | 2016159997 | 10/2016 | | |
| WO | WO-2020263961 | A1 * 12/2020 | | E21B 17/023 |

OTHER PUBLICATIONS

PCT International Search Report and Written Opinion; Application No. PCT/US2023/013607; dated Jun. 19, 2023; 14 pages.

*Primary Examiner* — Caroline N Butcher
(74) *Attorney, Agent, or Firm* — Jeffrey D. Frantz

(57) ABSTRACT

A centralizer operable to connect with and centralize a downhole tool within a tubular string within a wellbore and to facilitate reception of electromagnetic signals transmitted through the Earth. The centralizer has a body, a first contacting member electrically connected to the body and extending radially away from the body such that the first contacting member contacts an inner surface of the tubular string to electrically connect the tubular string to the body, and a second contacting member electrically insulated from the body and extending radially away from the body such that the second contacting member contacts the inner surface of the tubular string to centralize at least a portion of the body within the tubular string.

20 Claims, 3 Drawing Sheets

(56) References Cited

U.S. PATENT DOCUMENTS

| | | | | |
|---|---|---|---|---|
| 2012/0145410 | A1 | 6/2012 | Levie | |
| 2014/0238659 | A1 | 8/2014 | Wheater et al. | |
| 2021/0404326 | A1* | 12/2021 | Wilson | E21B 47/13 |
| 2022/0085482 | A1* | 3/2022 | White | H01Q 3/34 |

* cited by examiner

DOWNHOLE CENTRALIZER

BACKGROUND OF THE DISCLOSURE

Oil and gas wells are drilled into subterranean geological formations below Earth's surface or ocean bed to recover natural deposits of formation fluid (e.g., oil and gas) trapped within reservoirs in such subterranean formations. After (or as) a wellbore is drilled, casing may be cemented within the wellbore. Thereafter, production tubing is installed within the casing to facilitate delivery of treatment fluid downhole and transfer the formation fluid to the surface.

Subsurface valves, sensors, and/or other downhole tools may be conveyed or installed within the casing and/or production tubing. Operation of such downhole tools may depend on centering within the casing and/or production tubing and/or direct electrical contact with the inner wall of the casing and/or production tubing. One or more downhole centralizers may be utilized to facilitate such centering and/or electrical contact.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a downhole centralizer having a body, a first contacting member, and a second contacting member. When the downhole centralizer is disposed within a downhole tubular string, the first contacting member is electrically connected to the body and extends radially away from the body such that the first contacting member contacts an inner surface of the downhole tubular string to electrically connect the downhole tubular string to the body, and the second contacting member is electrically insulated from the body and extends radially away from the body such that the second contacting member contacts the inner surface of the downhole tubular string to centralize at least a portion of the body within the downhole tubular string.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
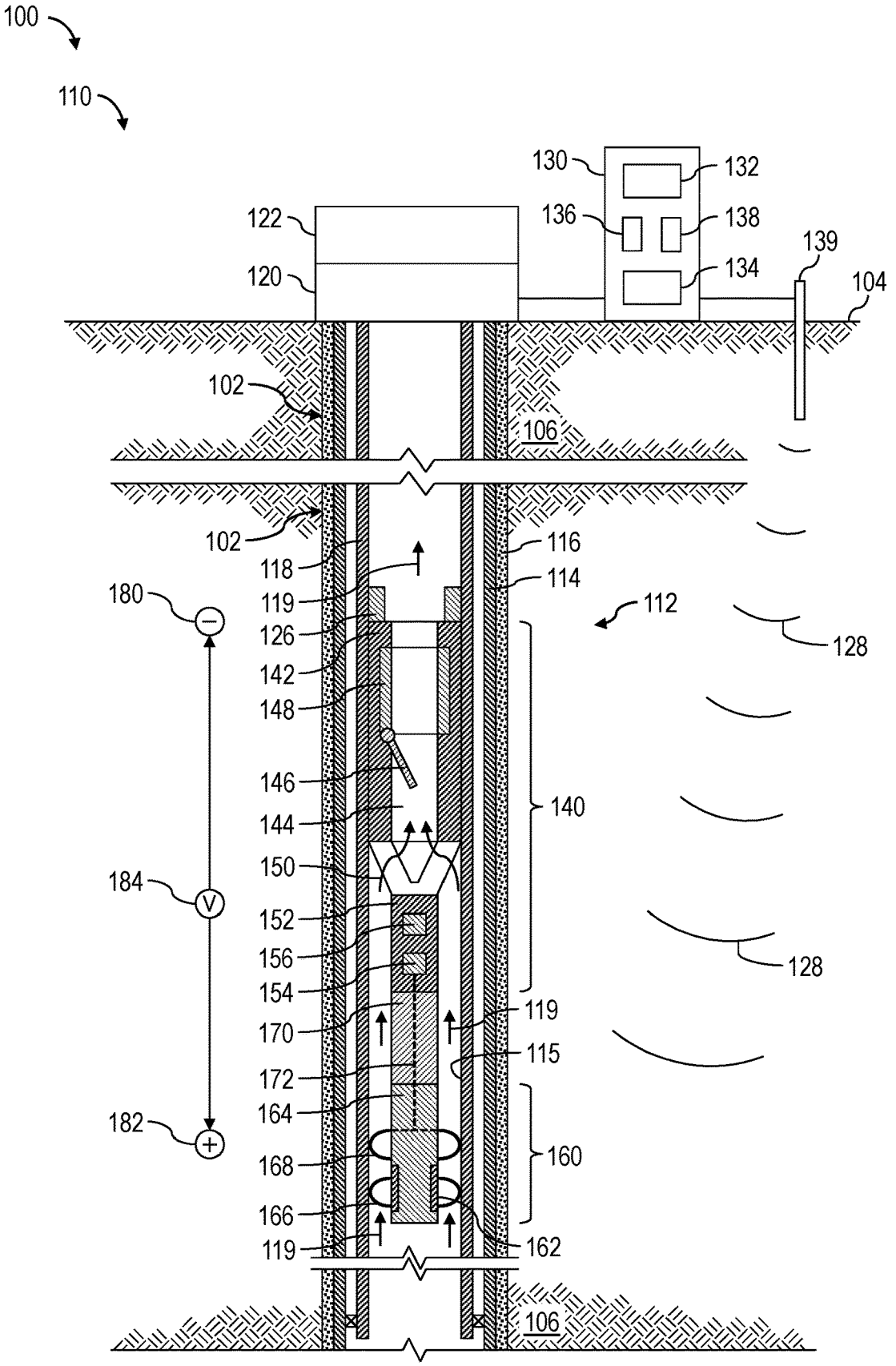
FIG. 1 is a schematic view of at least a portion of an example implementation of a system according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity and does not in itself dictate a relationship between the various embodiments and/or configurations discussed. Moreover, the description of a first feature in contact with a second feature in the description that follows may include implementations in which the first and second features are in direct contact and may also include implementations in which additional features may interpose the first and second features, such that the first and second features may not be in direct contact.

FIG. 1 is a schematic view of at least a portion of an example implementation of a wellsite system 100 representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106 of the Earth. The wellsite system 100 may be utilized to facilitate recovery of oil, gas, and/or other materials that are trapped in the formation 106 via the wellbore 102. The wellsite system 100 includes surface equipment 110 located at the wellsite surface 104 and downhole equipment 112 installed or otherwise disposed within the wellbore 102. It is noted that although the wellsite system 100 is depicted as an onshore implementation, it is to be understood that the aspects described below are also generally applicable or readily adaptable to offshore implementations.

Casing string 114 is secured by cement 116 within the wellbore 102. Production tubing 118 is installed within the casing 114 to transfer formation fluid to the wellsite surface 104. The surface equipment 110 may comprise a wellhead 120 and one or more fluid control devices 122 capping the opening of the wellbore 102 at the wellsite surface 104. The fluid control devices 122 may be connected to the wellhead 120 and the wellhead 120 may be connected to an upper end of the casing 114. The fluid control devices 122 may include various valves for controlling fluid flow in and out of the wellbore 102.

The surface equipment 110 may further comprise a power and control system 130 (e.g., a control center) for monitoring and controlling various portions of the wellsite system 100. The power and control system 130 may be located at the well site surface 104 or on a structure located at the wellsite surface 104. However, the power and control system 130 may instead be located at a remote location from the wellsite surface 104. The power and control system 130 may include a source of electrical power 132 and a surface controller 134. The electrical power source 132 (e.g., a battery, an electric generator, etc.) may supply electrical power to various equipment of the wellsite system 100, including the surface equipment 110 and the downhole equipment 112. The surface controller 134 (e.g., a processing device, a computer, etc.) may store executable programs and/or instructions, including for implementing one or more aspects of methods, processes, and operations described herein. The surface controller 134 may be communicatively connected with various equipment of the wellsite system 100, such as may permit the surface controller 134 to monitor operations of one or more portions of the wellsite system 100. The surface controller 134 may be further operable to automatically output control data to one or more portions of the wellsite system 100 (including the surface equipment 110 and the downhole equipment 112), such as to provide automatic control of one or more portions of the well site system 100. The surface controller 134 may also or instead be used by wellsite personnel (i.e., a human operator) to manually control one or more portions of the wellsite system 100. The surface controller 134 may include input devices 136 (e.g., a joystick, a keyboard, etc.) for receiving commands from the wellsite personnel and output devices 138 (e.g., a video monitor, audio speakers, etc.) for displaying information to the wellsite personnel.

The power and control system 130 may be communicatively connected with one or more pieces of the downhole equipment 112 via a wireless communication means operable to transmit wireless signals containing data (e.g., control data) through the subterranean formation 106. For example, the power and control system 130 may be communicatively (or electrically) connected with the wellhead 120 and the casing 114 extending into the subterranean formation 106. Such communicative connection may be referred to as a "wellhead connection." The power and control system 130 may be further communicatively with a surface transmitter 139 (e.g., an antenna) extending into the subterranean formation 106. Such communicative connection may be referred to as a "ground connection." The surface transmitter 139 may be operable to transmit (or output) wireless signals 128 between the ground connection and the wellhead connection through the subterranean formation 106. The wireless signals 128 may propagate through the subterranean formation 106 and be received by the downhole equipment 112, such as to control the downhole equipment 112. The wireless signals 128 transmitted by the surface transmitter 139 may be or comprise EM waves.

The downhole equipment 112 may further comprise an SCSSV 140 connected to the production tubing 118 via an anchoring device 126 (e.g., lock mandrel). The SCSSV 140 is operable to close a flow pathway of the production tubing 118 to prevent flow 119 of the formation fluid in the uphole direction.

The SCSSV 140 may comprise a body 142 defining a flow pathway 144, a fluid shutter 146 (e.g., a flapper, a gate, etc.) for selectively blocking flow 150 of the formation fluid through the flow pathway 144, and an actuator unit 148 for moving or otherwise operating the fluid shutter 146 between an open-flow position and a closed-flow position. The SCSSV 140 may further comprise a control device 152 operable to control operation of the actuator unit 148. The control device 152 may comprise a receiver 154 operable to receive the wireless signals 128 transmitted from the well site surface 104 by the transmitter 139 and extract control data from the wireless signals 128 or otherwise prepare the wireless signals 128 for processing by a processor 156. The processor 156 may be operable to receive the control data from the receiver 154, process (e.g., interpret) the control data, and output the control data to the actuator unit 148. The transmitter 139 and the receiver 154 may thus facilitate surface-to-downhole telemetry to communicate data from the power and control system 130 to the SCSSV 140.

The downhole equipment 112 may further comprise a downhole centralizing tool 160 (referred to hereinafter as a "centralizer") directly or indirectly connected to the SCSSV 140 and operable to centralize at least a portion of the SCSSV 140 within the production tubing 118. The centralizer 160 may be connected downhole from the SCSSV 140. Intermediate downhole devices or equipment 170 may be connected between the SCSSV 140 and the centralizer 160.

The centralizer 160 may comprise a body 164 and contacting members 166, 168 (e.g., arms, blades, wheels, springs, etc.) extending radially away from the body 164 such that the contacting members 166, 168 are operable to contact an inner surface 115 of the production tubing 118. The contacting members 166 may be operable to centralize at least a portion of the body 164 within the production tubing 118, whereas the contacting members 168 may be operable to electrically connect the body 164 to the production tubing 118. The contacting members 166 may be electrically insulated from the body 164 by an electrical insulator 162, such that just the contacting members 168 electrically connect the body 164 to the production tubing 118. Accordingly, the contacting members 166 may be dedicated just to centralizing the body 164 (and the SCSSV 140) within the production tubing 118, whereas the contacting members 168 may be dedicated just for electrically connecting the body 164 to the production tubing 118.

The production tubing 118 provides an electrical contact so that the centralizer 160 may operate as an antenna receiving the wireless signals 128, wherein an upstream electrical contact is made with the anchoring device 126 and a downstream electrical contact is made with the centralizer 160. Accordingly, the wireless signals 128 may be measured by the receiver 154 at two different axial locations of the production tubing 118 and then compared. The receiver 154 may then determine the electrical potential between the upstream and downstream electrical contacts. The SCSSV 140 may thus operate as an electrical dipole, with the upstream electrical contact operating as a negative electrical pole 180, the downstream electrical contact operating as a positive electrical pole 182, and the receiver 154 of the SCSSV 140 operating as a voltmeter 184 operable to measure the electrical potential between the negative and positive poles 180, 182. The receiver 154 of the SCSSV 140 may be electrically connected to the production tubing 118 via an upper electrical pathway (not shown) of the anchoring device 126, other downhole devices (not shown) that may be connected between the anchoring device 126 and the SCSSV 140, and the body 142 of the SCSSV 140. The downstream electrical contact forming the positive pole 182 is via the contacting member 168 of the downhole centralizer 160 in mechanical and electrical contact with the production tubing 118. The receiver 154 may be electrically connected to the production tubing 118 via an electrical pathway 172 of the downhole centralizer 160, the intermediate downhole devices 170, and the body 142 of the SCSSV 140.

After the receiver 154 receives (or determines) the wireless signals 128 in the form of electrical (e.g., voltage) signals, the receiver 154 may prepare (e.g., adjust the voltage of, digitize, etc.) the electrical signals for reception by the processor 156 and then output the electrical signals to the processor 156. The processor 156 may process the electrical signals (or the data in the electrical signal) and output electrical signals (containing control data) to the actuator unit 148 to thereby control operation of the fluid shutter 146.

However, aspects of the present disclosure are also applicable or readily adaptable to telemetries and/or downhole tools other than the surface-to-downhole telemetry and the SCSSV 140 described above, such that the centralizer 160 may facilitate the reception of electrical signals other than the above-described wireless signals 128. For example, in an implementation (not shown) that may not utilize the surface transmitter 139, the downhole tool may be a measurement tool that measures electrical current via contact between the centralizer 160 and the production tubing 118 or the casing 114. In such implementations, the downhole tool may record the measured electrical current, which may then be recovered after the tool is retrieved from the well. In a similar implementation (not shown), the downhole tool may perform the measurement in real-time while the tool is still downhole, such as via wireline, digital slickline, and/or another wired telemetry system by which the downhole tool is connected to a surface acquisition system of the surface equipment 110. In another example implementation (not shown), the downhole tool may operate via EM downhole-to-surface telemetry such that the downhole tool may communicate from downhole to the surface. Acoustic telemetry may also be utilized instead of EM telemetry, in which case the above-described EM system is replaced by acoustic repeaters and acquisition on the rig floor.

Figure 2:
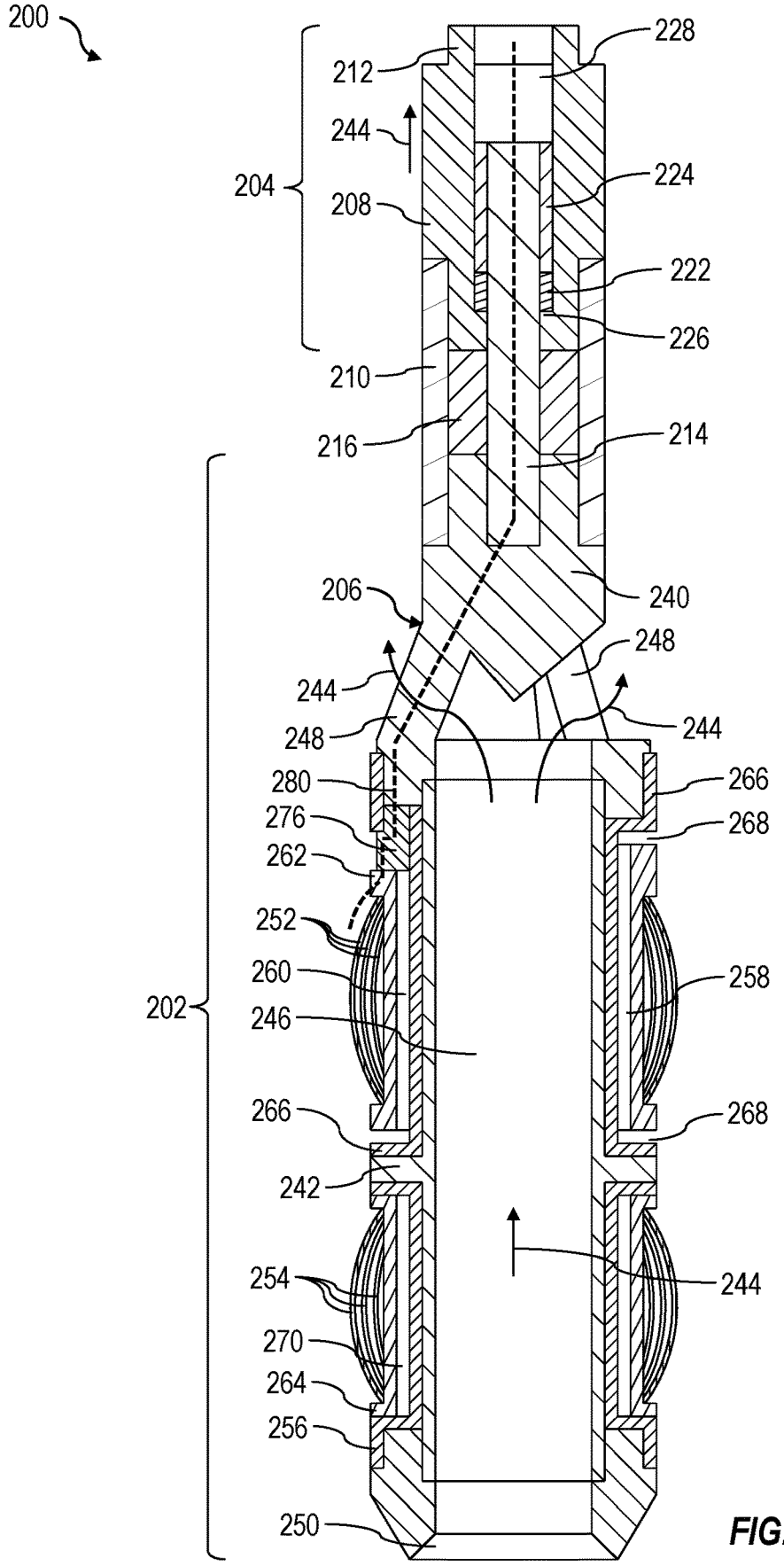
FIG. 2 is a sectional view of at least a portion of an example implementation of a downhole centralizing tool that may be utilized in the system of FIG. 1 according to one or more aspects of the present disclosure.

FIG. 2 is a sectional view of at least a portion of an example implementation of the centralizer 160 shown in FIG. 1 according to one or more aspects of the present disclosure, designated by reference number 200. The centralizer 200 is utilized to contact an inner surface of the production tubing 118 or the casing 114, which are collectively referred to hereafter as "the downhole tubular string," to electrically connect a downhole tool (such as the downhole tools described above) to the downhole tubular string. The centralizer 200 may also be utilized to centralize the downhole tool within the downhole tubular string.

The centralizer 200 comprises a contacting portion 202 operable to contact an inner surface of the downhole tubular string and a connecting portion 204 for connecting the centralizer 200 to the downhole tool. The connecting portion 204 comprises a mechanical interface (e.g., threads) 212 and an electrical interface 228 for mechanically and electrically connecting the centralizer 200 to corresponding mechanical and electrical interfaces of the downhole tool. The contacting portion 202 comprises a lower body 206 and the connecting portion 204 comprises an upper body 208. The bodies 206, 208 are mechanically connected to inhibit relative movement, such as by a connecting rod 214. However, the bodies 206, 208 are electrically insulated from each other, such as by an electrical insulator 216.

The connecting rod 214 may be threadedly connected to the lower body 206, whereas a latching ring 222 disposed about the connecting rod 214 may connect the connecting rod 214 to the upper body 208. The latching ring 222 may be retained on the connecting rod 214 by a retaining ring 224 threadedly connected to the connecting rod 214. The latching ring 222 may latch against an inward extending shoulder 226 of the upper body 208, thereby connecting the connecting rod 214 to the upper body 208. The latching ring 222 may be formed from an insulating material to electrically insulate the connecting rod 214 from the upper body 208. The electrical interface 228 may be electrically connected to the connecting rod 214 and, thus, to the lower body 206 via the connecting rod 214. The electrical interface 228, the retaining ring 224, and the connecting rod 214 may not be electrically connected to the upper body 208, such as by not being in direct physical contact with the upper body 208. Another insulator 210 may also extend around a lower portion of the upper body 208, the insulator 216, and an upper portion of the lower body 206. The insulator 210 may have a length that is sufficient to inhibit electrical communication (or conduction) between the bodies 206, 208 via fluid surrounding the centralizer 200 within the downhole tubular string.

The lower body 206 may comprise an upper portion 240 connected to the upper body 208 and a lower body portion 242 supporting and/or encompassing the various components of the contacting portion 202. The connecting portion 204 and the upper portion 240 may form a smaller diameter portion of the centralizer 200, having an outer diameter sized to define an annular fluid pathway with respect to the downhole tubular string, thereby permitting upward flow 244 of fluid when the centralizer 200 is disposed within the downhole tubular string. The lower body portion 242 may be a part of a larger diameter portion of the centralizer 200 having an inner diameter 246 sized to define a pathway for the upward fluid flow 244 through an inlet 250. The upper portion 240 may be connected to the lower body portion 242 by structural members 248 spaced apart to permit flow therebetween and facilitate a transition between the annular fluid pathway and the axial fluid pathway.

The contacting portion 202 comprises upper and lower contacting members 252, 254 extending radially away from the lower body portion 242 such that each contacting member 252, 254 is operable to contact the inner surface of the downhole tubular string. The upper contacting members 252 may be operable to electrically connect the lower body 206 to the downhole tubular string and the lower contacting members 254 may be operable to centralize at least a portion of the lower body 206 (and, thus, the connected downhole tool) within the downhole tubular string. The lower contacting members 254 may be electrically insulated from the lower body portion 242 by a lower electrical insulator 256 disposed between the lower body portion 242 and the lower contacting members 254, such that just the upper contacting members 252 electrically connect the lower body 206 to the downhole tubular string. Accordingly, the lower contacting members 254 may be just for centralizing the lower body 206 within the downhole tubular string and the upper contacting members 252 may be just for electrically connecting the lower body 206 to the downhole tubular string.

The upper contacting members 252 may be mechanically connected to the lower body portion 242 in a manner permitting limited relative radial and/or axial movement between the lower body 206 and the upper contacting members 252 when the downhole tubular string and/or the lower body 206 is moving (e.g., vibrating), such as may be caused by the fluid flow 244. Such mechanical connection may be referred to as a mechanically loose connection. For example, the upper contacting members 252 may move radially and/or axially with respect to the lower body 206 while maintaining contact with the inner surface of the downhole tubular string. The lower body 206 may move radially and/or axially with respect to the upper contacting members 252 while the upper contacting members 252 maintain contact with the inner surface of the downhole tubular string. The mechanically loose connection between the upper contacting members 252 and the lower body portion 242 may thus permit the upper contacting members 252 to maintain a steady contact with the downhole tubular string and, thus, inhibit friction and/or loss of physical and electrical contact between the upper contacting members 252 and the inner surface of the downhole tubular string. The lower contacting members 254 may be mechanically connected to the lower body portion 242 in a manner preventing relative radial and/or axial movement between the lower body 206 and the lower contacting members 254. Such mechanical connection may be referred to as a mechanically fixed connection.

The contacting portion 202 may further comprise an upper connecting member 262 mechanically connected to the lower body portion 242 in a manner permitting limited relative radial and/or axial movement between the upper connecting member 262 and the lower body 206. The upper connecting member 262 may therefore be configured to limit relative radial and/or axial movement with respect to the lower body 206, e.g., a mechanically loose connection. The upper contacting members 252 may be mechanically connected to the upper connecting member 262 to loosely connect the upper contacting members 252 to the lower body portion 242. The contacting portion 202 also comprises a lower connecting member 264 mechanically connected to the lower body portion 242 in a manner preventing or inhibiting relative radial and/or axial movement between the lower body 206 and the lower connecting member 264. The lower connecting member 264 may thus be configured to inhibit relative radial and/or axial movement with respect to the lower body 206, e.g., a mechanically fixed connection. The lower contacting members 254 may be mechanically connected to the lower connecting member 264 to fixedly connect the lower contacting members 254 to the lower body portion 242.

The upper connecting member 262 may be disposed within a circumferential channel 260 extending radially into an outer surface of the lower body portion 242. The channel 260 may be defined by an outer surface of the lower body portion 242 and shoulders of the lower body portion 242 extending radially outward. An upper electrical insulator 266 may line the channel 260 or otherwise be disposed between the upper connecting member 262 and the lower body portion 242 to electrically insulate the upper connecting member 262 from the lower body 206. The insulator 256 may electrically insulate the upper connecting member 262 from the lower body portion 242, thereby inhibiting friction and/or cyclical loss of physical and electrical contact between the upper connecting member 262 and the lower body 206 when the upper connecting member 262 and the lower body 206 are moving relative to each other. The axial length of the upper connecting member 262 may be smaller than the axial length of the channel 260, thereby defining axial spaces 268 permitting limited relative axial movement between the upper connecting member 262 and the lower body 206.

The lower connecting member 264 may be disposed within a circumferential channel 270 extending radially into an outer surface of the lower electrical insulator 256 disposed between the lower connecting member 264 and the lower body portion 242. The channel 270 may be defined by an outer surface of the lower electrical insulator 256 and shoulders of the lower electrical insulator 256 extending radially outward from the outer surface of the lower electrical insulator 256. The lower connecting member 264 may be fixedly connected to the lower body portion 242, such as to prevent or inhibit relative radial and/or axial movement between the lower body 206 and the lower connecting member 264. For example, the lower connecting member 264 may be in contact with the outer surface and the shoulders of the lower electrical insulator 256 defining the circumferential channel 270, thereby preventing or inhibiting relative radial and/or axial movement between the lower connecting member 264 (and thus the lower contacting members 254) and the lower body 206.

Each of the upper contacting members 252 may be or comprise a flexible member flexing (or bending) in a radially outward direction and operable to flex (or bend) radially inward toward the lower body portion 242 when the upper contacting member 252 contacts the inner surface of the downhole tubular string. Similarly, each of the lower contacting members 254 may be or comprise a flexible member flexing in a radially outward direction and operable to flex radially inward toward the lower body portion 242 when the contacting member 254 contacts the inner surface of the downhole tubular string when the centralizer 200 is disposed within the downhole tubular string. Each of the contacting members 252, 254 may comprise, for example, a blade, a beam, or a leaf spring. The upper contacting members 252 and the lower contacting members 254 may extend longitudinally along the lower body portion 242 and be distributed circumferentially around the lower body portion 242.

Each upper contacting member 252 is an elongated member having an upper end connected to an upper end of the upper connecting member 262, a lower end connected to a lower end of the upper connecting member 262, and an intermediate portion arching radially outward. Similarly, each lower contacting member 254 is an elongated member having an upper end connected to an upper end of the lower connecting member 264, a lower end connected to a lower end of the lower connecting member 264, and an intermediate portion arching radially outward.

The contacting portion 202 may further comprise an electrical conductor 276 operable to electrically connect the upper connecting member 262 to the lower body 206. Because the upper contacting members 252 may be in contact with and, thus, electrically connected to the upper connecting member 262, the electrical conductor 276 may thus facilitate electrical connection between the upper contacting members 252 and the lower body 206. The electrical conductor 276 may be or comprise a flexible electrical conductor operable to facilitate a steady (or constant) electrical connection (or contact) between the upper connecting member 262 and the lower body 206 and, thus, facilitate a steady electrical connection between the upper contacting members 252 and the lower body 206. Because the electrical insulator 256 electrically insulates the upper connecting member 262 from the lower body portion 242, the electrical connection between the upper connecting member 262 and the lower body 206 may be facilitated just by the electrical conductor 276. The electrical conductor 276 may be connected to the lower body portion 242 and connected to the upper connecting member 262 during relative radial and/or axial movement between the lower body 206 and the upper connecting member 262. For example, the electrical conductor 276 may be or comprise a flexible metal tab (e.g., a bar, a leaf spring, etc.) having one end fixedly connected to the lower body portion 242 and an opposing end fixedly connected to the upper connecting member 262 during relative radial and/or axial movement between the lower body 206 and the upper connecting member 262. The electrical conductor 276 may also or instead be or comprise a flexible metal rod (e.g., a wire, a coil spring, etc.) having one end fixedly connected to the lower body portion 242 and an opposing end fixedly connected to the upper connecting member 262 during relative radial and/or axial movement between the lower body 206 and the upper connecting member 262.

The centralizer 200 may define a portion of an electrical pathway 280 extending between the downhole tubular string and the downhole tool directly or indirectly coupled above the centralizer 200. Such electrical pathway 280 may facilitate the transmission of signals from the downhole tubular string to the downhole tool. The electrical pathway 280 may include the upper contacting members 252, the upper connecting member 262, the electrical conductor 276, the lower body 206, the connecting rod 214, and the electrical interface 228.

As described above, the upper contacting members 252 may be loosely connected to the lower body 206 to permit limited relative radial and/or axial movement between the upper contacting members 252 and the lower body 206 and, thus, prevent or reduce friction and/or cyclical loss of physical contact between the upper contacting members 252 and the inner surface of the downhole tubular string. Such prevention or reduction of friction and/or cyclical loss of physical contact between the upper contacting members 252 and the inner surface of the downhole tubular string may reduce the amount of electrical noise that is generated in the signals transmitted along the electrical pathway 280 and, thus, received by the downhole tool. Furthermore, the loose connection between the upper contacting members 252 and the lower body 206 may also cause friction and/or cyclical loss of physical contact between the upper connecting member 262 and the lower body 206 when the upper connecting member 262 and the lower body 206 move relative to each other during operations. However, as described above, the upper connecting member 262 may be electrically connected to the lower body 206 by the electrical conductor 276 and electrically insulated from the lower body 206 by the insulator 266 to prevent direct electrical connection and transmission between the upper connecting member 262 and the lower body 206. Such electrical connection and insulation between the upper connecting member 262 and the lower body 206 may reduce the amount of electrical noise that would have been generated in the signals transmitted along the electrical pathway 280 if the upper connecting member 262 and the lower body 206 have been capable of direct physical contact (and electrical connection) and undergoing friction and/or cyclical loss of physical contact when the downhole tubular string and/or the lower body 206 have been moving during production operations.

Figure 3:
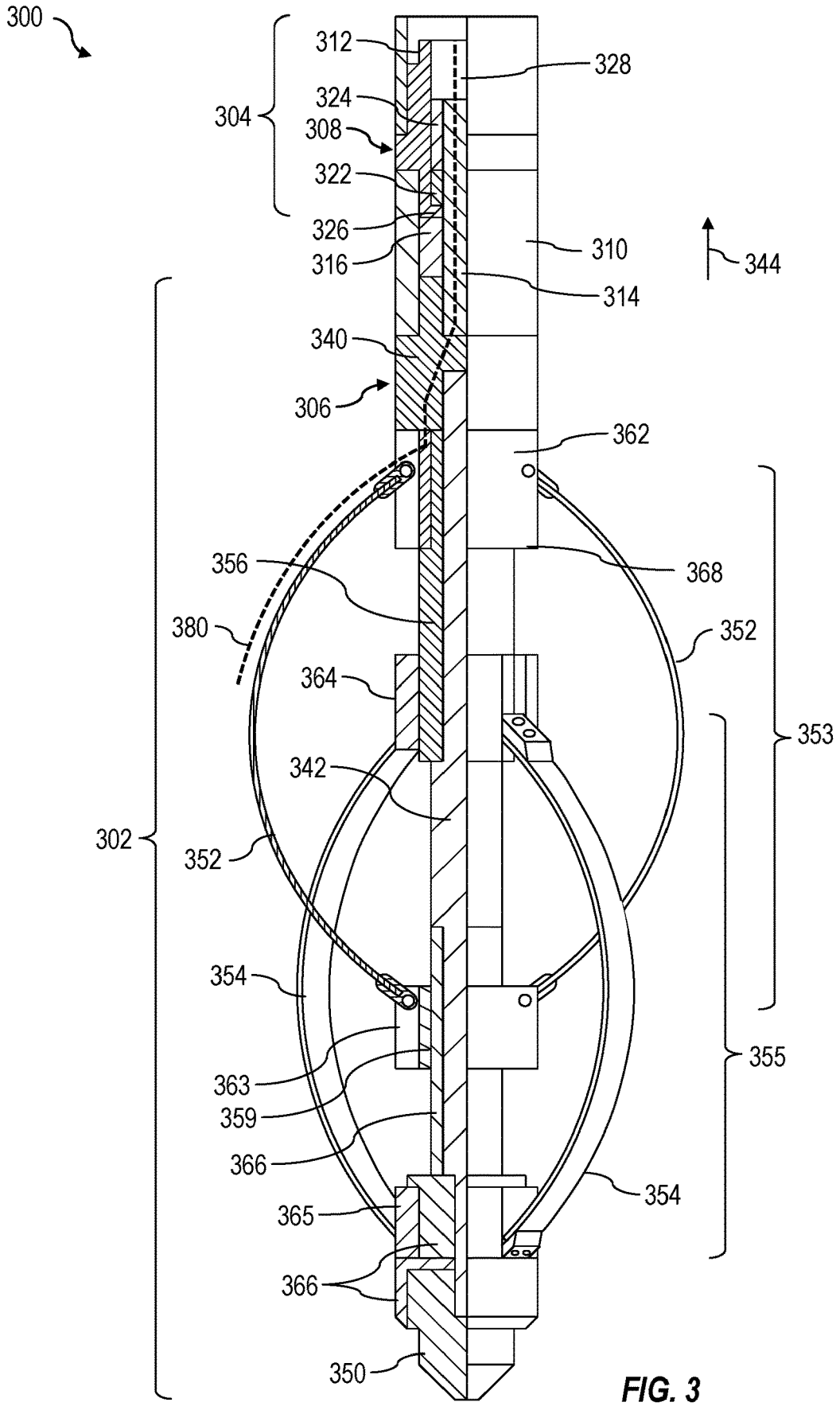
FIG. 3 is a partial sectional view of at least a portion of another example implementation of a downhole centralizing tool that may be utilized in the system of FIG. 1 according to one or more aspects of the present disclosure.

FIG. 3 is a partial sectional view of at least a portion of another example implementation of the centralizer 200 shown in FIG. 2 according to one or more aspects of the present disclosure, designated by reference number 300. The centralizer 300 comprises a contacting portion 302 operable to contact an inner surface of the downhole tubular string and a connecting portion 304 for connecting the centralizer 300 to the downhole tool. The connecting portion 304 comprises a mechanical interface (e.g., threads) 312 and an electrical interface 328 for mechanically and electrically connecting the centralizer 300 to corresponding mechanical and electrical interfaces of the downhole tool.

The contacting portion 302 comprises a lower body 306 and the connecting portion 304 comprises an upper body 308. The bodies 306, 308 are mechanically connected to inhibit relative movement, such as by a connecting rod 314. However, the bodies 306, 308 are electrically insulated from each other, such as by an electrical insulator 316.

The connecting rod 314 may be threadedly connected to the lower body 306, whereas a latching ring 322 disposed about the connecting rod 314 may connect the connecting rod 314 to the upper body 308. The latching ring 322 may be retained on the connecting rod 314 by a retaining ring 324 threadedly connected to the connecting rod 314. The latching ring 322 may latch against an inward extending shoulder 326 of the upper body 308, thereby connecting the connecting rod 314 to the upper body 308. The latching ring 322 may be formed from an insulating material to electrically insulate the connecting rod 314 from the upper body 308. The electrical interface 328 may be electrically connected to the connecting rod 314 and, thus, to the lower body 306 via the connecting rod 314. The electrical interface 328, the retaining ring 324, and the connecting rod 314 may not be electrically connected to the upper body 308, such as by not being in direct physical contact with the upper body 308. Another insulator 310 may also extend around a lower portion of the upper body 308, the insulator 316, and an upper portion of the lower body 306. The insulator 310 may have a length that is sufficient to inhibit electrical communication (or conduction) between the bodies 306, 308 via fluid surrounding the centralizer 300 within the downhole tubular string.

The lower body 306 may comprise an upper portion 340 connected to the upper body 308 and a lower portion 342 supporting the various components of the contacting portion 302. The upper portion 340 may be threadedly connected to the lower portion 342. The lower portion 342 may be or comprise a cylindrical shaft or rod. The lower portion 342 may comprise or be connected to a lower end 350 adapted to reduce friction against the formation fluid flowing upward along the downhole tubular string past the centralizer 300 during the operations.

The contacting portion 302 may comprise a plurality of upper contacting members 352 and a plurality of lower contacting members 354 extending radially outward for contacting the inner surface of the downhole tubular string. The upper contacting members 352 may be operable to electrically connect the lower body 306 to the downhole tubular string and the lower contacting members 354 may be operable to centralize at least a portion of the lower body 306 within the downhole tubular string. The lower contacting members 354 may be electrically insulated from the lower portion 342 by electrical insulators 356, 366 disposed between the lower portion 342 and the lower contacting members 354, such that just the upper contacting members 352 electrically connect the lower body 306 to the downhole tubular string. Accordingly, the lower contacting members 354 may be just for centralizing the lower body 306 within the downhole tubular string and the upper contacting members 352 may be just for electrically connecting the lower body 306 to the downhole tubular string.

The upper contacting members 352 may be mechanically connected to the lower portion 342 in a manner permitting limited relative radial and/or axial movement between the lower body 306 and the upper contacting members 352 when the downhole tubular string and/or the lower body 306 is moving (e.g., vibrating), which may be caused, for example, by fluid flow through the downhole tubular string along the centralizer 300 during operations. For example, the upper contacting members 352 may move radially and/or axially with the downhole tubular string and with respect to the lower body 306 while maintaining contact with the inner surface of the downhole tubular string. The lower body 306 may move radially and/or axially with respect to the upper contacting members 352 while the upper contacting members 352 maintain contact with the inner surface of the downhole tubular string. The loose connection between the upper contacting members 352 and the lower portion 342 may thus permit the upper contacting members 352 to maintain steady contact with the downhole tubular string and, thus, prevent or inhibit friction and/or loss of physical (and electrical) contact between the upper contacting members 352 and the downhole tubular string. At least a portion of the lower contacting members 354 may be mechanically connected to the lower portion 342 in a manner preventing or inhibiting relative radial and/or axial movement between the lower body 306 and the lower contacting members 354.

The contacting portion 302 comprises an upper connecting member 362 and a lower connecting member 363 each mechanically connected to the lower portion 342 in a manner permitting limited relative radial and/or axial movement between the connecting members 362, 363 and the lower body 306. The connecting members 362, 363 may therefore be configured for limited relative radial and/or axial movement with respect to the lower body 306. The upper contacting members 352 are mechanically connected to the connecting members 362, 363 to loosely connect the upper contacting members 352 to the lower portion 342. The contacting portion 302 also comprises an upper connecting member 364 and a lower connecting member 365, at least one of which is mechanically connected to the lower portion 342 in a manner preventing or inhibiting relative radial and/or axial movement between the lower body 306 and the connecting members 364, 365. At least one of the connecting members 364, 365 may therefore be configured to prevent or inhibit relative radial and/or axial movement with respect to the lower body 306. The lower contacting members 354 may be mechanically connected to the connecting members 364, 365 to thereby fixedly connect at least a portion of the lower contacting members 354 to the lower portion 342.

The upper electrical insulator 356 extends around an outer surface of the lower portion 342 to electrically insulate the upper connecting member 362 from the lower body 306. The lower electrical insulator 366 extends around the outer surface of the lower portion 342 to electrically insulate the lower connecting member 363 from the lower body 306. The lower connecting member 363 may be slidably connected to the lower portion 342 such that the lower connecting member 363 can slide axially along the lower portion 342 and, thus, permit at least a portion of the upper contacting members 352 to move axially along the lower portion 342.

The upper electrical insulator 356 may extend around the outer surface of the lower portion 342 to electrically insulate the upper connecting member 364 from the lower body 306. The upper connecting member 364 may be slidably connected to the lower portion 342 such that the upper connecting member 364 can slide axially along the lower portion 342 and, thus, permit at least a portion of the lower contacting members 354 to move axially along the lower portion 342. The lower electrical insulator 366 may extend around the outer surface of the lower portion 342 to electrically insulate the lower connecting member 365 from the lower body 306. The lower connecting member 365 may be fixedly connected to the lower portion 342 to prevent or inhibit the lower connecting member 365 and the lower body 306 from moving radially and/or axially with respect to each other.

The upper connecting member 362 may be or comprise a sleeve mechanically connected to the lower portion 342 in a manner permitting limited relative radial and/or axial movement between the lower body 306 and the upper connecting member 362. For example, an inner diameter of the upper connecting member 362 may be larger than an outer diameter of the outer surface of the upper electrical insulator 356.

The lower connecting member 363 may be or comprise a sleeve mechanically connected to the lower portion 342 in a manner permitting limited relative radial and/or axial movement between the lower body 306 and the lower connecting member 363. For example, an inner diameter of the lower connecting member 363 may be larger than an outer diameter of the outer surface of the lower electrical insulator 366.

The lower connecting member 365 may be or comprise a sleeve mechanically connected to the lower portion 342 in a manner that prevents or inhibits relative radial and/or axial movement between the lower body 306 and the lower connecting member 365. For example, the lower connecting member 365 may be in contact with the outer surface and the shoulders of the lower electrical insulator 366.

The upper connecting member 364 may be or comprise a sleeve mechanically connected to the lower portion 342 in a manner permitting limited relative axial movement (or sliding) and preventing or inhibiting radial movement of the upper connecting member 364 with respect to the lower body 306 and the lower connecting member 365. For example, an inner diameter of the upper connecting member 364 may closely match (be substantially equal to or slightly larger than) an outer diameter of the outer surface of the upper electrical insulator 356, so as to prevent or inhibit relative radial movement between the upper connecting member 364 (and the upper contacting members 352) and the lower body 306 while permitting relative axial movement between the upper connecting member 364 (and at least a portion of the upper contacting members 352) and the lower body 306 (and the lower connecting member 365).

Each upper and lower contacting member 352, 354 is a flexible member bowed radially outward and operable to flex radially inward in response to contact with the downhole tubular string. For example, each contacting member 352, 354 may be or comprise a blade, a beam, or a leaf spring.

Each upper contacting member 352 has an upper end connected to the upper connecting member 362, a lower end connected to the lower connecting member 363, and an intermediate portion bowed radially outward. Similarly, each lower contacting member 354 has an upper end connected to the upper connecting member 364, a lower end connected to the lower connecting member 365, and an intermediate portion bowed radially outward. Each upper contacting member 352 is pivotably connected to the connecting members 362, 363 and each lower contacting member 354 is pivotably connected to the connecting members 364, 365.

The upper and lower contacting members 352, 354 extend longitudinally along the lower portion 342 and are distributed circumferentially around the lower portion 342. Each upper contacting member 352 may comprise an upper axial length 353 extending axially along the lower portion 342 and each lower contacting member 354 may comprise a lower axial length 355 extending axially along the lower portion 342. Each of the upper and lower axial lengths 353, 355 may overlap axially along the lower portion 342. For example, the upper connecting member 364 may be located between the upper and lower connecting members 362, 363 and the lower connecting member 363 may be located between the upper and lower connecting members 364, 365. The upper and lower contacting members 352, 354 may be azimuthally offset from each other. Although the centralizer 300 is shown comprising two upper contacting members 352 and two lower contacting members 354, it is to be understood that the centralizer 300 may comprise two, four, five, or more of each of the upper and lower contacting members 352, 354.

The centralizer 300 includes an electrical pathway 380 extending between the downhole tubular string and the downhole tool directly or indirectly coupled to the centralizer 300. Such electrical pathway 380 may facilitate the transmission of signals from the downhole tubular string to the downhole tool. The electrical pathway 380 may include the upper contacting members 352, the upper connecting member 362, the upper portion 340, the connecting rod 314, and the electrical interface 328.

Utilizing a centralizer according to one or more aspects described above may aid in ensuring the mechanical centralizing of the tool string, such as during setting and retrieving operations. The centralizer may also or instead aid in optimizing downhole signal reception for most of production tubing sizes, due to a flexible electrical floating contact. This is particularly the case with regard to the implementation depicted in FIG. 3. For example, the blade-like contacting members 352, 354 may permit about 10 times more flexibility to different tubing sizes compared to previous designs and are also much cheaper per unit than previous contact systems. This increased flexibility may also permit purchasing the centralizer in bigger quantities because one design fits so many different tubing sizes or locations, which further decreases unit pricing. The blade-like contacting members 352, 354 may also improve reliability by providing a much more robust way to convey signals between from downhole tubing to a downhole tool string. Thus, the currently introduced design of centralizer and EM/electrical signals receiver with decoupled functions may provide improved flexibility, reliability, and cost efficiency.

As described above, the centralizers 200, 300 (and potentially others within the scope of the present disclosure) may perform multiple functions, including a mechanical function (centralizing a tool or tool string within a downhole tubular while being conveyed within the tubular) and an electrical function (maintaining the lower electrical contact). Such functions may be performed by the same features, such as the contacting members 252, 254 or the contacting members 352, 354. As described above, the contacting members 252, 254, 352, 354 may be or comprise arms, blades, wheels, springs, and/or other features able to perform both the mechanical and electrical functions. However, the number of contacting members 252, 254, 352, 354 comprised by a centralizer within the scope of the present disclosure may differ from the example implementations depicted in FIGS. 2 and 3. For example, in implementations in which the contacting members resemble the flexible blades depicted in FIG. 3, each upper and lower group of contacting members may include a number of blades other than as depicted in FIG. 3. For example, although not illustrated as such in FIG. 3, centralizer 300 may comprise two, three, four, or another number of the upper contacting members 352 and two, three, four, or another number of the lower contacting members 354, and/or the total number of contacting members 352, 354 may collectively be six, eight, or another number. Such variations may also be applicable to implementations in which one or more of the contact members are or comprise wheels and/or other features not shown in FIG. 3.

In view of the entirety of the present disclosure, including the figures and the claims, a person having ordinary skill in the art will readily recognize that the present disclosure introduces an apparatus comprising a downhole centralizer comprising a body, a first contacting member, and a second contacting member, characterized in that when the downhole centralizer is disposed within a downhole tubular string installed within a wellbore extending through the Earth: the first contacting member is electrically connected to the body and extends radially away from the body such that the first contacting member is operable to contact an inner surface of the downhole tubular string to electrically connect the downhole tubular string to the body; and the second contacting member is electrically insulated from the body and extends radially away from the body such that the second contacting member is operable to contact the inner surface of the downhole tubular string to centralize at least a portion of the body within the downhole tubular string.

The downhole centralizer may be operable to: (A) connect with a downhole tool to centralize at least a portion of the downhole tool within the downhole tubular string; and (B) facilitate one of: (i) receiving electrical measurement signals from the downhole tubular string; (ii) receiving electromagnetic signals transmitted through the Earth from the Earth's surface; and (iii) transmitting electromagnetic signals or acoustic signals through the Earth to the Earth's surface.

The first contacting member may be mechanically connected to the body to permit limited relative radial and/or axial movement between the first contacting member and the body, and the second contacting member may be mechanically connected to the body to inhibit relative radial and/or axial movement between the second contacting member and the body.

The downhole centralizer may further comprise: a first connecting member connected to the body such that the first connecting member is permitted limited relative radial and/or axial movement between the first connecting member and the body, wherein the first contacting member is connected to the first connecting member; and a second connecting member connected to the body such that the second connecting member has inhibited relative radial and/or axial movement relative to the body, wherein the second connecting member is electrically insulated from the body, and wherein the second contacting member is connected to the second connecting member. The first connecting member may be or comprise a sleeve disposed about the body. The first connecting member may be electrically insulated from the body to prevent direct electrical connection between the first connecting member and the body. A first end of the first contacting member may be connected to the first connecting member, the downhole centralizer may further comprise a third connecting member connected to the body such that the third connecting member is permitted limited relative radial and/or axial movement between the third connecting member and the body, a second end of the first contacting member may be connected to the third connecting member, an intermediate portion of the first contacting member may be operable to contact the inner surface of the downhole tubular string to electrically connect the downhole tubular string to the body when the downhole centralizer is disposed within the downhole tubular string, a first end of the second contacting member may be connected to the second connecting member, the downhole centralizer may further comprise a fourth connecting member connected to the body such that the fourth connecting member has inhibited relative radial and/or axial movement relative to the body, a second end of the second contacting member may be connected to the fourth connecting member, and an intermediate portion of the second contacting member may be operable to contact the inner surface of the downhole tubular string to centralize the at least a portion of the body within the downhole tubular string when the downhole centralizer is disposed within the downhole tubular string. The third connecting member may be disposed between the second connecting member and the fourth connecting member, and the fourth connecting member may be disposed between the first connecting member and the third connecting member.

The first contacting member may comprise a first axial length extending axially along the body, the second contacting member may comprise a second axial length extending axially along the body, and the first axial length and the second axial length may overlap axially along the body.

The first contacting member may be a first instance of a plurality of first contacting members, the second contacting member may be a first instance of a plurality of second contacting members, and each of the first contacting members may be azimuthally offset from each of the second contacting members.

The first contacting member may be operable to flex radially toward the body when the first contacting member contacts the inner surface of the downhole tubular string when the downhole centralizer is disposed within the downhole tubular string, and the second contacting member may be operable to flex radially toward the body when the second contacting member contacts the inner surface of the downhole tubular string when the downhole centralizer is disposed within the downhole tubular string.

The downhole centralizer may be operable to connect with a downhole tool, centralize at least a portion of the downhole tool within the downhole tubular string, and facilitate reception of electromagnetic signals transmitted through the Earth from the Earth's surface. In such implementations, among others within the scope of the present disclosure, the first contacting member may be mechanically connected to the body to permit limited relative radial and/or axial movement between the first contacting member and the body, and the second contacting member may be mechanically connected to the body to inhibit relative radial and/or axial movement between the second contacting member and the body. The following paragraphs refer to such implementations.

The downhole centralizer may further comprise: a first connecting member connected to the body such that the first connecting member is permitted limited relative radial and/or axial movement between the first connecting member and the body, wherein the first contacting member is connected to the first connecting member; and a second connecting member connected to the body such that the second connecting member has inhibited relative radial and/or axial movement relative to the body, wherein the second connecting member is electrically insulated from the body, and wherein the second contacting member is connected to the second connecting member. The first connecting member may be or comprise a sleeve disposed about the body. The first connecting member may be electrically insulated from the body to prevent direct electrical connection between the first connecting member and the body.

A first end of the first contacting member may be connected to the first connecting member, the downhole centralizer may further comprise a third connecting member connected to the body such that the third connecting member is permitted limited relative radial and/or axial movement between the third connecting member and the body, a second end of the first contacting member may be connected to the third connecting member, an intermediate portion of the first contacting member may be operable to contact the inner surface of the downhole tubular string to electrically connect the downhole tubular string to the body when the downhole centralizer is disposed within the downhole tubular string, a first end of the second contacting member may be connected to the second connecting member, the downhole centralizer may further comprise a fourth connecting member connected to the body such that the fourth connecting member has inhibited relative radial and/or axial movement relative to the body, a second end of the second contacting member may be connected to the fourth connecting member, and an intermediate portion of the second contacting member may be operable to contact the inner surface of the downhole tubular string to centralize the at least a portion of the body within the downhole tubular string when the downhole centralizer is disposed within the downhole tubular string. The third connecting member may be disposed between the second connecting member and the fourth connecting member, and the fourth connecting member may be disposed between the first connecting member and the third connecting member.

The first contacting member may comprise a first axial length extending axially along the body, the second contacting member may comprise a second axial length extending axially along the body, and the first axial length and the second axial length may overlap axially along the body.

The first contacting member may be a first instance of a plurality of first contacting members, the second contacting member may be a first instance of a plurality of second contacting members, and each of the first contacting members may be azimuthally offset from each of the second contacting members.

The first contacting member may be operable to flex radially toward the body when the first contacting member contacts the inner surface of the downhole tubular string when the downhole centralizer is disposed within the downhole tubular string, and the second contacting member may be operable to flex radially toward the body when the second contacting member contacts the inner surface of the downhole tubular string when the downhole centralizer is disposed within the downhole tubular string.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the scope of the present disclosure, and that they may make various changes, substitutions, and alterations herein without departing from the scope of the present disclosure.

The abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a downhole centralizer comprising a body, a first contacting member, and a second contacting member;

wherein the first contacting member is mechanically connected to the body to permit limited relative radial and/or axial movement between the first contacting member and the body;

wherein the second contacting member is mechanically connected to the body to inhibit relative radial and/or axial movement between the second contacting member and the body; and wherein when the downhole centralizer is disposed within a downhole tubular string installed within a wellbore extending through the Earth:

the first contacting member is electrically connected to the body and extends radially away from the body such that the first contacting member contacts an inner surface of the downhole tubular string to electrically connect the downhole tubular string to the body; and the second contacting member is electrically insulated from the body and extends radially away from the body such that the second contacting member contacts the inner surface of the downhole tubular string to centralize at least a portion of the body within the downhole tubular string.

2. The apparatus of claim 1 wherein the downhole centralizer is operable to:

connect with a downhole tool to centralize at least a portion of the downhole tool within the downhole tubular string; and facilitate one of:

receiving electrical measurement signals from the downhole tubular string;

receiving electromagnetic signals transmitted through the Earth from the Earth's surface; or transmitting electromagnetic signals or acoustic signals through the Earth to the Earth's surface.

3. The apparatus of claim 1 wherein the first contacting member is a first instance of a plurality of first contacting members, wherein the second contacting member is a first instance of a plurality of second contacting members, and wherein each of the first contacting members is azimuthally offset from each of the second contacting members.

4. The apparatus of claim 1 wherein:

the first contacting member is operable to flex radially toward the body when the first contacting member contacts the inner surface of the downhole tubular string when the downhole centralizer is disposed within the downhole tubular string; and the second contacting member is operable to flex radially toward the body when the second contacting member contacts the inner surface of the downhole tubular string when the downhole centralizer is disposed within the downhole tubular string.

5. An apparatus comprising:

a downhole centralizer comprising:

a body;

a first contacting member;

a second contacting member;

a first connecting member connected to the body such that the first connecting member is permitted limited relative radial and/or axial movement between the first connecting member and the body, wherein the first contacting member is connected to the first connecting member; and a second connecting member connected to the body such that the second connecting member has inhibited relative radial and/or axial movement relative to the body, wherein the second connecting member is electrically insulated from the body, and wherein the second contacting member is connected to the second connecting member;

wherein when the downhole centralizer is disposed within a downhole tubular string installed within a wellbore extending through the Earth:

the first contacting member is electrically connected to the body and extends radially away from the body such that the first contacting member contacts an inner surface of the downhole tubular string to electrically connect the downhole tubular string to the body; and the second contacting member is electrically insulated from the body and extends radially away from the body such that the second contacting member contacts the inner surface of the downhole tubular string to centralize at least a portion of the body within the downhole tubular string.

6. The apparatus of claim 5 wherein the first connecting member is or comprises a sleeve disposed about the body.

7. The apparatus of claim 5 wherein the first connecting member is electrically insulated from the body to prevent direct electrical connection between the first connecting member and the body.

8. The apparatus of claim 5 wherein:

a first end of the first contacting member is connected to the first connecting member;

the downhole centralizer further comprises a third connecting member connected to the body such that the third connecting member is permitted limited relative radial and/or axial movement between the third connecting member and the body;

a second end of the first contacting member is connected to the third connecting member;

an intermediate portion of the first contacting member is operable to contact the inner surface of the downhole tubular string to electrically connect the downhole tubular string to the body when the downhole centralizer is disposed within the downhole tubular string;

a first end of the second contacting member is connected to the second connecting member;

the downhole centralizer further comprises a fourth connecting member connected to the body such that the fourth connecting member has inhibited relative radial and/or axial movement relative to the body;

a second end of the second contacting member is connected to the fourth connecting member; and an intermediate portion of the second contacting member is operable to contact the inner surface of the downhole tubular string to centralize the at least a portion of the body within the downhole tubular string when the downhole centralizer is disposed within the downhole tubular string.

9. The apparatus of claim 8 wherein the third connecting member is disposed between the second connecting member and the fourth connecting member, and wherein the fourth connecting member is disposed between the first connecting member and the third connecting member.

10. An apparatus comprising:

a downhole centralizer comprising a body, a first contacting member comprising a first axial length extending axially along the body and a second contacting member comprising a second axial length extending axially along the body;

wherein the first axial length and the second axial length overlap axially along the body;

wherein when the downhole centralizer is disposed within a downhole tubular string installed within a wellbore extending through the Earth:

the first contacting member is electrically connected to the body and extends radially away from the body such that the first contacting member contacts an inner surface of the downhole tubular string to electrically connect the downhole tubular string to the body; and the second contacting member is electrically insulated from the body and extends radially away from the body such that the second contacting member contacts the inner surface of the downhole tubular string to centralize at least a portion of the body within the downhole tubular string.

11. The apparatus of claim 10, wherein the downhole centralizer is operable to:

connect with a downhole tool to centralize at least a portion of the downhole tool within the downhole tubular string; and facilitate one of:

receiving electrical measurement signals from the downhole tubular string;

receiving electromagnetic signals transmitted through the Earth from the Earth's surface; or transmitting electromagnetic signals or acoustic signals through the Earth to the Earth's surface.

12. An apparatus comprising:

a downhole centralizer comprising a body, a first contacting member, and a second contacting member, wherein:

the downhole centralizer is operable to:

connect with a downhole tool;

centralize at least a portion of the downhole tool within the downhole tubular string; and facilitate reception of electromagnetic signals transmitted through the Earth from the Earth's surface;

the first contacting member is mechanically connected to the body to permit limited relative radial and/or axial movement between the first contacting member and the body; and the second contacting member is mechanically connected to the body to inhibit relative radial and/or axial movement between the second contacting member and the body;

wherein when the downhole centralizer is disposed within a downhole tubular string installed within a wellbore extending through the Earth:

the first contacting member is electrically connected to the body and extends radially away from the body such that the first contacting member contacts an inner surface of the downhole tubular string to electrically connect the downhole tubular string to the body; and the second contacting member is electrically insulated from the body and extends radially away from the body such that the second contacting member contacts the inner surface of the downhole tubular string to centralize at least a portion of the body within the downhole tubular string.

13. The apparatus of claim 12 wherein the downhole centralizer further comprises:

a first connecting member connected to the body such that the first connecting member is permitted limited relative radial and/or axial movement between the first connecting member and the body, wherein the first contacting member is connected to the first connecting member; and a second connecting member connected to the body such that the second connecting member has inhibited relative radial and/or axial movement relative to the body, wherein the second connecting member is electrically insulated from the body, and wherein the second contacting member is connected to the second connecting member.

14. The apparatus of claim 13 wherein the first connecting member is or comprises a sleeve disposed about the body.

15. The apparatus of claim 13 wherein the first connecting member is electrically insulated from the body to prevent direct electrical connection between the first connecting member and the body.

16. The apparatus of claim 13 wherein:

a first end of the first contacting member is connected to the first connecting member;

the downhole centralizer further comprises a third connecting member connected to the body such that the third connecting member is permitted limited relative radial and/or axial movement between the third connecting member and the body;

a second end of the first contacting member is connected to the third connecting member;

an intermediate portion of the first contacting member is operable to contact the inner surface of the downhole tubular string to electrically connect the downhole tubular string to the body when the downhole centralizer is disposed within the downhole tubular string;

a first end of the second contacting member is connected to the second connecting member;

the downhole centralizer further comprises a fourth connecting member connected to the body such that the fourth connecting member has inhibited relative radial and/or axial movement relative to the body;

a second end of the second contacting member is connected to the fourth connecting member; and an intermediate portion of the second contacting member is operable to contact the inner surface of the downhole tubular string to centralize the at least a portion of the body within the downhole tubular string when the downhole centralizer is disposed within the downhole tubular string.

17. The apparatus of claim 16 wherein the third connecting member is disposed between the second connecting member and the fourth connecting member, and wherein the fourth connecting member is disposed between the first connecting member and the third connecting member.

18. The apparatus of claim 12 wherein:

the first contacting member comprises a first axial length extending axially along the body;

the second contacting member comprises a second axial length extending axially along the body; and the first axial length and the second axial length overlap axially along the body.

19. The apparatus of claim 12 wherein the first contacting member is a first instance of a plurality of first contacting members, wherein the second contacting member is a first instance of a plurality of second contacting members, and wherein each of the first contacting members is azimuthally offset from each of the second contacting members.

20. The apparatus of claim 12 wherein:

the first contacting member is operable to flex radially toward the body when the first contacting member contacts the inner surface of the downhole tubular string when the downhole centralizer is disposed within the downhole tubular string; and the second contacting member is operable to flex radially toward the body when the second contacting member contacts the inner surface of the downhole tubular string when the downhole centralizer is disposed within the downhole tubular string.

* * * * *